US011527335B2

(12) United States Patent
Zhang et al.

(10) Patent No.: US 11,527,335 B2
(45) Date of Patent: Dec. 13, 2022

(54) ELECTRONIC BLACKBODY CAVITY AND SECONDARY ELECTRON DETECTION DEVICE USING THE SAME

(71) Applicants: Tsinghua University, Beijing (CN); HON HAI PRECISION INDUSTRY CO., LTD., New Taipei (TW)

(72) Inventors: Ke Zhang, Beijing (CN); Guo Chen, Beijing (CN); Peng Liu, Beijing (CN); Kai-Li Jiang, Beijing (CN); Shou-Shan Fan, Beijing (CN)

(73) Assignees: Tsinghua University, Beijing (CN); HON HAI PRECISION INDUSTRY CO., LTD., New Taipei (TW)

( * ) Notice: Subject to any disclaimer, the term of this patent is extended or adjusted under 35 U.S.C. 154(b) by 119 days.

(21) Appl. No.: 17/225,702

(22) Filed: Apr. 8, 2021

(65) Prior Publication Data

US 2022/0199279 A1 Jun. 23, 2022

(30) Foreign Application Priority Data

Dec. 17, 2020 (CN) ..... 202011497833.5

(51) Int. Cl.
*G21K 1/10* (2006.01)

(52) U.S. Cl.
CPC ..... *G21K 1/10* (2013.01)

(58) Field of Classification Search
CPC ..... G21K 1/10; G01T 1/16; H01J 2237/204; H01J 29/122; H01J 29/7613; H01J 2237/2448
See application file for complete search history.

(56) References Cited

U.S. PATENT DOCUMENTS

| | | | | |
|---|---|---|---|---|
| 7,641,885 | B2 | 1/2010 | Liu et al. | |
| 9,469,530 | B2 | 10/2016 | Wei et al. | |
| 9,481,125 | B2 | 11/2016 | Wei et al. | |
| 2003/0127594 | A1 | 7/2003 | Schneiker | |
| 2013/0284925 | A1* | 10/2013 | Tanigaki | H01J 37/22 250/311 |
| 2015/0368105 | A1 | 12/2015 | Wei et al. | |

FOREIGN PATENT DOCUMENTS

| | | |
|---|---|---|
| CN | 112011232 | 12/2020 |
| JP | 2005-32542 | 2/2005 |
| JP | 2008-297195 | 12/2008 |
| JP | 2015-196640 | 11/2015 |
| JP | 2016-003180 | 1/2016 |
| JP | 2020-9779 | 1/2020 |
| TW | 201609528 | 3/2016 |

* cited by examiner

*Primary Examiner* — Don K Wong
(74) *Attorney, Agent, or Firm* — ScienBiziP, P.C.

(57) ABSTRACT

A electronic blackbody cavity is provided. The electronic blackbody cavity comprises an inner surface; a chamber surrounded by the inner surface; an opening configured to make an electron beam enter the chamber; and a porous carbon material layer located on the inner surface. The porous carbon material layer consists of a plurality of carbon material particles and a plurality of micro gaps. The plurality of micro gaps are defined by the plurality of carbon material particles. A secondary electron detection device using the electronic blackbody cavity is also provided.

20 Claims, 10 Drawing Sheets

ELECTRONIC BLACKBODY CAVITY AND SECONDARY ELECTRON DETECTION DEVICE USING THE SAME

CROSS-REFERENCE TO RELATED APPLICATIONS

This application claims all benefits accruing under 35 U.S.C. § 119 from China Patent Application No. 202011497833.5, filed on Dec. 17, 2020, in the China Intellectual Property Office, the contents of which are hereby incorporated by reference. The application is also related to copending applications entitled, "DEVICE AND METHOD FOR DETECTING ELECTRON BEAM", filed Apr. 8, 2021 (Ser. No. 17/225,696); "SECONDARY ELECTRON PROBE AND SECONDARY ELECTRON DETECTOR", filed Apr. 8, 2021 (Ser. No. 17/225,707); "METHOD FOR MAKING ELECTRONIC BLACKBODY STRUCTURE AND ELECTRONIC BLACKBODY STRUCTURE", filed Apr. 8, 2021 (Ser. No. 17/225,713); "ELECTRONIC BLACKBODY MATERIAL AND ELECTRON DETECTOR", filed Apr. 8, 2021 (Ser. No. 17/225,721); and "DEVICE AND METHOD FOR MEASURING ELECTRON BEAM", filed Apr. 8, 2021 (Ser. No. 17/225,726).

FIELD

The present disclosure relates to an electronic blackbody cavity and a secondary electron detection device using the electronic blackbody cavity.

BACKGROUND

Electron-absorbing components are often required to absorb electrons in a microelectronics technology field. Metals are usually used to absorb electrons. However, when the metals are used to absorb electrons, a large number of electrons are reflected or transmitted on a surface of the metals and cannot be absorbed by the metals. Therefore, an absorption efficiency of electrons is low.

At present, there is no material that can absorb nearly 100% of electrons; this material can also be called an electronic blackbody. Therefore, it is a great significance to design an electronic blackbody cavity with an absorption rate of almost 100%.

BRIEF DESCRIPTION OF THE DRAWINGS

Implementations of the present technology will now be described, by way of example only, with reference to the attached figures, wherein.

DETAILED DESCRIPTION

Figure 1:
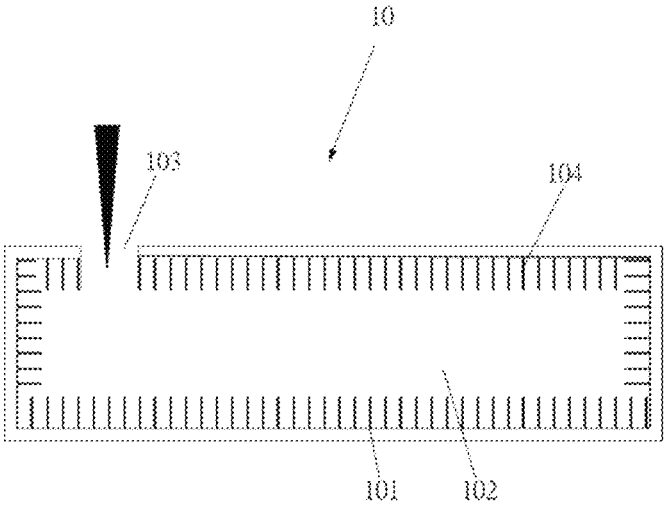
FIG. 1 is a structure schematic diagram of one embodiment of an electronic blackbody cavity.

The disclosure is illustrated by way of example and not by way of limitation in the figures of the accompanying drawings in which like references indicate similar elements. It should be noted that references to "another," "an," or "one" embodiment in this disclosure are not necessarily to the same embodiment, and such references mean "at least one."

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale, and the proportions of certain parts have been exaggerated to better illustrate details and features of the present disclosure.

Several definitions that apply throughout this disclosure will now be presented.

The term "substantially" is defined to be essentially conforming to the particular dimension, shape, or other feature which is described, such that the component need not be exactly or strictly conforming to such a feature. The term "comprise," when utilized, means "include, but not necessarily limited to"; it specifically indicates open-ended inclusion or membership in the so-described combination, group, series, and the like.

Referring to FIG. 1, one embodiment is described in relation to an electronic blackbody cavity 10. The electronic blackbody cavity 10 comprises an inner surface 101, a chamber 102 and an opening 103. The chamber 102 is surrounded by the inner surface 101. The opening 103 is used to allow an electron beam to enter the chamber 102. A porous carbon material layer 104 is located on the inner surface 101. The porous carbon material layer 104 comprises a plurality of carbon material particles, and there are a plurality of micro gaps between the plurality of carbon material particles. A size of each of the plurality of micro gaps is in nanoscale or microscale. The porous carbon material layer 104 is a self-standing structure. The term "self-standing" means that the porous carbon material layer 104 can maintain its own specific shape without being supported by a substrate.

There are nanoscale or microscale gaps between the plurality of carbon material particles in the porous carbon material layer 104. When the secondary electrons enter the porous carbon material layer 104, the secondary electrons are refracted and reflected multiple times in the plurality of micro gaps between the plurality of carbon material particles, and the secondary electrons cannot be emitted from the porous carbon material layer 104, and thus an electron absorption rate of the porous carbon material layer 102 can reach more than 99.99% and almost 100%. Therefore, the porous carbon material layer 104 can be regarded as an absolute blackbody of secondary electrons. When the electron beam hits the inner surface 101 of the electron blackbody cavity 10, the electrons and the secondary electrons escaping from the inner surface 101 of the electron blackbody cavity 10 can be completely absorbed by the porous carbon material layer 104 located on the inner surface 101, thereby shielding the secondary electrons generated by the cavity itself.

The size of each of the plurality of micro gaps is in nanoscale or microscale. The term "nanoscale" means that the size of each of the plurality of micro gaps is less than or equal to 1000 nanometers, and the term "microscale" means that the size of each of the plurality of micro gaps is less than or equal to 1000 micrometers. In some embodiments, the term "nanoscale" means that the size of each of the plurality of micro gaps is less than or equal to 100 nanometers, and the term "microscale" means that the size of each of the plurality of micro gaps is less than or equal to 100 micrometers. A plurality of microporous can be formed by the plurality of micro gaps between the carbon material particles in the porous carbon material layer 104. In one embodiment, a diameter of an aperture of each microporous of the plurality of microporous ranges from about 5 micrometers to about 50 micrometers. In one embodiment, the diameter of the aperture of each microporous of the plurality of microporous ranges from about 5 micrometers to about 30 micrometers.

In one embodiment, the porous carbon material layer 104 is located on the entire inner surface 101 of the electronic blackbody cavity 10. When the porous carbon material layer 104 is used to detect the secondary electrons emitted from a sample, a position of the inner surface where the sample and a secondary electron detection element are located can not be provided with the porous carbon material layer 104.

In one embodiment, the porous carbon material layer 104 is a pure carbon structure, the pure carbon structure means that the porous carbon material layer 104 only consists of a plurality of carbon material particles without other impurities; and the plurality of carbon material particles are also pure carbon material particles, and a material of the pure carbon material particles only consists of carbon atoms. The "pure carbon material particles" means that a range of a purity of the plurality of carbon material particles is more than 99.99%.

A shape of each carbon material particle of the plurality of carbon material particles can be linear or spherical. The plurality of carbon material particles comprise at least one of linear particles and spherical particles. A diameter of a cross section of each of the linear particles is less than or equal to 1000 micrometers. The linear particles can be carbon fibers, carbon micron-wires, carbon nanotubes, or the like. A diameter of each of the spherical particles is less than or equal to 1000 micrometers. The spherical particles can be carbon nanospheres, carbon microspheres, or the like. In one embodiment, the plurality of carbon material particles are a plurality of carbon nanotubes, and the porous carbon material layer 104 is a carbon nanotube structure. In one embodiment, the carbon nanotube structure is a pure carbon nanotube structure, the pure carbon nanotube structure means that the carbon nanotube structure only consists of carbon nanotubes without other impurities, and the carbon nanotubes are also pure carbon nanotubes. The carbon nanotube structure is a carbon nanotube array or a carbon nanotube network structure.

In one embodiment, the carbon nanotube structure is the carbon nanotube array. There is a crossing angle between an extending direction of the carbon nanotubes of the carbon nanotube array and the inner surface 101. The crossing angle is greater than 0 degrees and less than or equal to 90 degrees. The crossing angle is more conducive to the plurality of micro gaps in the carbon nanotube array to prevent the secondary emitted from the carbon nanotube array, to improve the absorption rate of the carbon nanotube array for the secondary electrons; and thereby improving a shielding efficiency of the electronic blackbody cavity 10 to electrons. In one embodiment, the carbon nanotube structure is a super-aligned carbon nanotube array, and an extending direction of carbon nanotubes in the super-aligned carbon nanotube array is substantially perpendicular to the inner surface 101.

The super-aligned carbon nanotube array comprises a plurality of carbon nanotubes parallel to each other and perpendicular to the inner surface 101. The extending directions of the plurality of carbon nanotubes in the super-aligned carbon nanotube array are substantially the same. A minority of the plurality of carbon nanotubes in the super-aligned carbon nanotube array may be randomly aligned. However, the number of randomly aligned carbon nanotubes is very small and does not affect the overall oriented alignment of the majority of the plurality of carbon nanotubes in the carbon nanotube array. The super-aligned carbon nanotube array is free with impurities, such as amorphous carbon or residual catalyst metal particles, etc. The plurality of carbon nanotubes of the super-aligned carbon nanotube array are joined together through van der Waals forces to form an array. A size, a thickness, and a surface area of the super-aligned carbon nanotube array can be selected according to actual needs. Examples of a method of making the super-aligned carbon nanotube array is taught by U.S. Pat. No. 8,048,256 to Feng et al. The carbon nanotube array is not limited to the super-aligned carbon nanotube array, and can also be other carbon nanotube arrays.

A plurality of meshes can be formed between carbon nanotubes in the carbon nanotube network structure, and a size of each of the plurality of meshes is in nanoscale or microscale. The carbon nanotube network structure can be but not limited to a carbon nanotube sponge, a carbon nanotube film structure, a carbon nanotube paper, or a network structure comprising a plurality of carbon nanotube wires woven or entangled with each other.

The carbon nanotube sponge is a spongy carbon nanotube macroscopic structure formed by intertwining a plurality of carbon nanotubes, and the carbon nanotube sponge is a self-supporting porous structure.

Each of the plurality of carbon nanotube wires comprises a plurality of carbon nanotubes, and the plurality of carbon nanotubes are joined end to end through van der Waals forces to form a macroscopic wire structure. The carbon nanotube wire can be an untwisted carbon nanotube wire or a twisted carbon nanotube wire. The untwisted carbon nanotube wire comprises a plurality of carbon nanotubes substantially oriented along a length of the untwisted carbon nanotube wire. The twisted carbon nanotube wire comprises a plurality of carbon nanotubes spirally arranged along an axial direction of the twisted carbon nanotube wire. The twisted carbon nanotube wire can be formed by relatively rotating two ends of the untwisted carbon nanotube. During rotating the untwisted carbon nanotube wire, the plurality of carbon nanotubes of the untwisted carbon nanotube wire are arranged spirally along an axial direction and joined end to end by van der Waals force in an extension direction of the untwisted carbon nanotube wire, to form the twisted carbon nanotube wire.

The carbon nanotube film structure comprises a plurality of carbon nanotube films stacked with each other. Adjacent carbon nanotube films of the carbon nanotube film structure are combined by van der Waals forces, and a plurality of micro gaps are formed between the carbon nanotubes of the carbon nanotube film structure.

The carbon nanotube film can be a drawn carbon nanotube film, a flocculated carbon nanotube film or a pressed carbon nanotube film.

The drawn carbon nanotube film includes a number of carbon nanotubes that are arranged substantially parallel to a surface of the drawn carbon nanotube film. A large number of the carbon nanotubes in the drawn carbon nanotube film can be oriented along a preferred orientation, meaning that a large number of the carbon nanotubes in the drawn carbon nanotube film are arranged substantially along the same direction. An end of one carbon nanotube is joined to another end of an adjacent carbon nanotube arranged substantially along the same direction, by van der Waals force, to form a free-standing film. The term 'free-standing' includes films that do not have to be supported by a substrate. The drawn carbon nanotube film can be formed by drawing from a carbon nanotube array. A width of the drawn carbon nanotube film relates to the carbon nanotube array from which the drawn carbon nanotube film is drawn. A thickness of the carbon nanotube drawn film can range from about 0.5 nanometers to about 100 micrometers. Examples of a drawn carbon nanotube film is taught by U.S. Pat. No. 7,992,616 to Liu et al., and US patent application US 2008/0170982 to Zhang et al. In one embodiment, the carbon nanotube film structure is formed by a plurality of drawn carbon nanotube films stacked and crossed with each other. There is a cross angle between the carbon nanotubes in the adjacent carbon nanotube drawn films, and the cross angle is greater 0 degrees and less than and equal to 90 degrees. Therefore, the carbon nanotubes in the plurality of drawn carbon nanotube films are interwoven to form a networked film structure.

The flocculated carbon nanotube film can include a number of carbon nanotubes entangled with each other. The carbon nanotubes can be substantially uniformly distributed in the flocculated carbon nanotube film. The flocculated carbon nanotube film can be formed by flocculating the carbon nanotube array. Examples of the flocculated carbon nanotube film are taught by U.S. Pat. No. 8,808,589 to Wang et al.

The pressed carbon nanotube film can include a number of disordered carbon nanotubes arranged along a same direction or along different directions. Adjacent carbon nanotubes are attracted to each other and combined by van der Waals force. A planar pressure head can be used to press the carbon nanotubes array along a direction perpendicular to the substrate, a pressed carbon nanotube film having a plurality of isotropically arranged carbon nanotubes can be obtained. A roller-shaped pressure head can be used to press the carbon nanotubes array along a fixed direction, a pressed carbon nanotube film having a plurality of carbon nanotubes aligned along the fixed direction is obtained. The roller-shaped pressure head can also be used to press the array of carbon nanotubes along different directions, a pressed carbon nanotube film having a plurality of carbon nanotubes aligned along different directions is obtained. Examples of the pressed carbon nanotube film are taught by U.S. Pat. No. 7,641,885 to Liu et al.

The carbon nanotube paper comprises a plurality of carbon nanotubes arranged substantially along a same direction, and the plurality of carbon nanotubes are joined end to end by van der Waals force in an extending direction, and the plurality of carbon nanotubes are substantially parallel to a surface of the carbon nanotube paper. Examples of the carbon nanotube paper are taught by U.S. Pat. No. 9,017,503 to Zhang et al.

The carbon nanotube structure is substantially pure, and thus a specific surface area of the plurality of carbon nanotube of the carbon nanotube structure is large. Therefore, the carbon nanotube structure has a great stickiness. In one embodiment, the carbon nanotube structure is fixed on the inner surface 101 by its own great stickiness. In one embodiment, the carbon nanotube structure is fixed on the inner surface 101 by an adhesive.

The higher an energy of an electron beam, the greater a penetration depth in the porous carbon material layer 104, on the contrary, the smaller the penetration depth. In one embodiment, the energy of the electron beam is less than or equal to 20 keV, and a thickness of the porous carbon material layer 104 is in a range from about 200 micrometers to about 600 micrometers. When the thickness of the porous carbon material layer 104 is in the range of 200 micrometers to 600 micrometers, the electron beam does not easily penetrate the porous carbon material layer 104 and be reflected from the porous carbon material layer 104; and the porous carbon material layer 104 has a high electron absorption rate. In one embodiment, the thickness of the porous carbon material layer 104 is in a range from 300 micrometers to about 500 micrometers. In another embodiment, the thickness of the porous carbon material layer 104 is in a range from 250 micrometers to about 400 micrometers.

Figure 2:
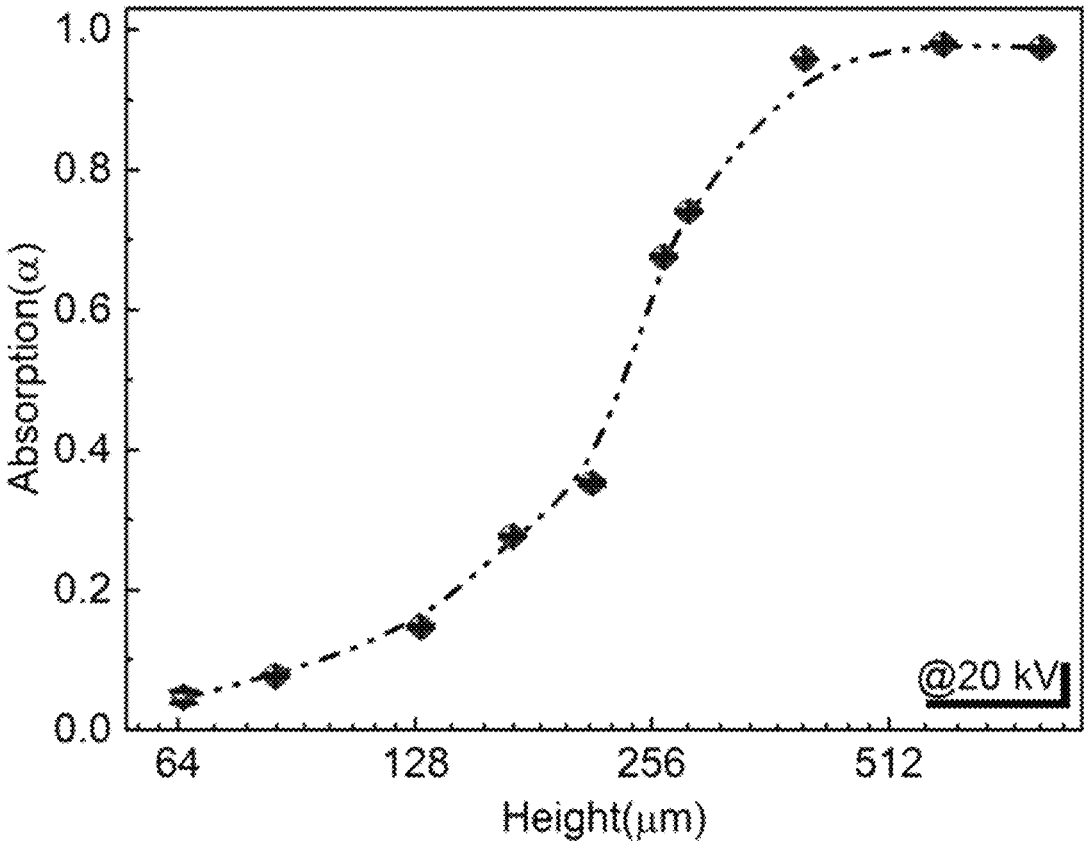
FIG. 2 is a change curve of an electron absorption rate of an electronic blackbody cavity with a height of a super-aligned carbon nanotube array.

In one embodiment, the porous carbon material layer 104 is the super-aligned carbon nanotube array. FIG. 2 is a change curve of the electron absorption rate of the electronic blackbody cavity 10 with the height of the super-aligned carbon nanotube array. It can be seen that as the height of the super-aligned carbon nanotube array increases, the electron absorption rate of the electronic blackbody cavity 10 increases. When the height of the super-aligned carbon nanotube array is about 500 micrometers, the electron absorption rate of the electronic blackbody cavity 10 is above 0.95 and close to 1.0. After the height of the super-aligned carbon nanotube array exceeds 540 micrometers, as the height of the super-aligned carbon nanotube array continues to increase, the electron absorption rate of the electronic blackbody cavity 10 is substantially unchanged.

In one embodiment, the porous carbon material layer 104 is the super-aligned carbon nanotube array, and the height of the super-aligned carbon nanotube array is in a range from about 350 micrometers to about 600 micrometers. When the thickness of the super-aligned carbon nanotube array is in the range of 350 micrometers to 600 micrometers, the electron beam does not easily penetrate the super-aligned carbon nanotube array and be reflected from the super-aligned carbon nanotube array; and the super-aligned carbon nanotube array has a high electron absorption rate. In one embodiment, the height of the super-aligned carbon nanotube array is in a range from 400 micrometers to about 550 micrometers. In another embodiment, the height of the super-aligned carbon nanotube array is 550 micrometers.

A cavity material of the electronic blackbody cavity 10 is a conductive material, such as a metal material, a metal alloy, and the like. In one embodiment, the cavity material of the electronic blackbody cavity 10 is an aluminum alloy material. A shape of the electronic blackbody cavity 10 can be designed according to actual needs. In one embodiment, the shape of the electronic blackbody cavity 10 is a cuboid.

Figure 3:
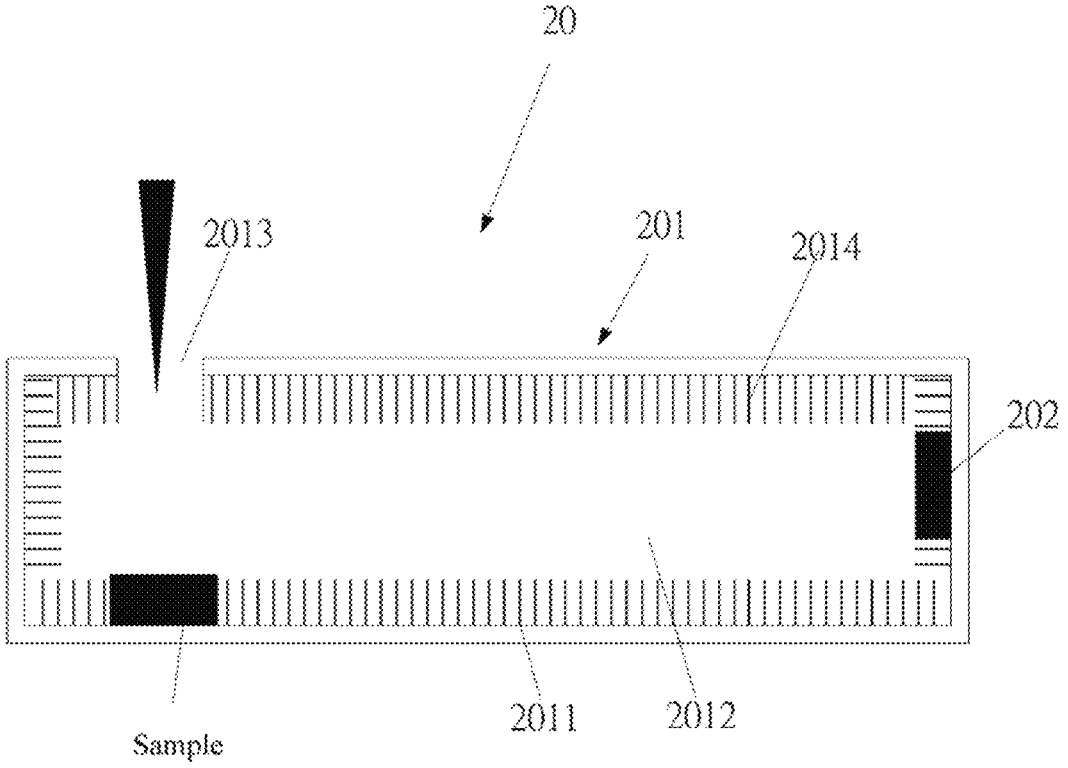
FIG. 3 is a structure schematic diagram of one embodiment of a secondary electron detection device.

Referring to FIG. 3, one embodiment is described in relation to a secondary electron detection device 20. The secondary electron detection device 20 comprises an electronic blackbody cavity 201 and a secondary electron detection element 202. The electronic blackbody cavity 201 comprises an inner surface 2011, a chamber 2012 and an opening 2013. The chamber 2012 is surrounded by the inner surface 2011. The secondary electron detection element 202 is located in the chamber 2012. An electron beam can enter the chamber 2012 through the opening 2013. A porous carbon material layer 2014 is located on the inner surface 2011 of the electronic blackbody cavity 201.

The electronic blackbody cavity 201 is the same as the electronic blackbody cavity 10, and the electronic blackbody cavity 201 comprises all the technical features of the electronic blackbody cavity 10. The porous carbon material layer 2014 is the same as the porous carbon material layer 104, and the porous carbon material layer 2014 comprises all the technical features of the porous carbon material layer 104.

In one embodiment, the secondary electron detection element 202 is located on the inner surface 2011, and a position of the inner surface 2011 where the secondary electron detecting element 202 is located on is not set with the porous carbon material layer 2014. That is, on the inner surface 2011 of the electronic blackbody cavity 201, the porous carbon material layer 2014 is located on other positions on the inner surface 2011 except for the position where the secondary electron detection element 202 is located on. In one embodiment, the secondary electron detection element 202 is located in the chamber 2012 through a fixed bracket and does not contact the inner surface 2011. In one embodiment, the secondary electron detection element 202 is located on the inner surface 2011 of a side wall of the electron blackbody cavity 201.

The secondary electron detection element 202 comprises a secondary electron probe 2021. In one embodiment, the secondary electron probe 2021 comprises a porous carbon material layer 2022, and the porous carbon material layer 2022 is insulated from the porous carbon material layer 2014. The porous carbon material layer 2022 is the same as the porous carbon material layer 2014 and the porous carbon material layer 104, and the porous carbon material layer 2022 comprises all the technical features of the porous carbon material layer 2014 and the porous carbon material layer 104.

The porous carbon material layer 2022 comprises a plurality of carbon material particles, and there are a plurality of micro gaps between the plurality of carbon material particles. A size of each of the plurality of micro gaps is in nanoscale or microscale. The porous carbon material layer 2022 is a self-standing structure. The term "self-standing" means that the porous carbon material layer 2022 can maintain its own specific shape without being supported by a substrate.

In one embodiment, the porous carbon material layer 2022 is a pure carbon structure, the pure carbon structure means that the porous carbon material layer 2022 only consists of a plurality of carbon material particles without other impurities; and the plurality of carbon material particles are also pure carbon material particles, and the pure carbon material particles only consists of carbon atoms.

The plurality of carbon material particles comprise at least one of linear particles and spherical particles. A diameter of a cross section of each of the linear particles is less than or equal to 1000 micrometers. The linear particles can be carbon fibers, carbon micron-wires, carbon nanotubes, and the like. A diameter of each of the spherical particles is less than or equal to 1000 micrometers. The spherical particles can be carbon nanospheres, carbon microspheres, and the like. In one embodiment, the plurality of carbon material particles are a plurality of carbon nanotubes, and the porous carbon material layer 2022 is the carbon nanotube structure. The carbon nanotube structure is the carbon nanotube array or the carbon nanotube network structure.

In one embodiment, the secondary electron probe 2021 comprises the porous carbon material layer 2022, there are nanoscale or microscale gaps between the plurality of carbon material particles in the porous carbon material layer 2022. When the secondary electrons enter the porous carbon material layer 2022, the secondary electrons are refracted and reflected multiple times in the plurality of micro gaps between the plurality of carbon material particles, and the secondary electrons cannot be emitted from the porous carbon material layer 2022, the porous carbon material layer 2022 can be regarded as an absolute blackbody of secondary electrons. The porous carbon material layer 2022 has an excellent collection effect on secondary electrons, when the secondary electrons escaping from the surface of the sample, the secondary electrons are detected by the secondary electron probe 2021 using the porous carbon material layer 2022, there is substantially no secondary electron is missed. Therefore, the secondary electron probe 2021 using the porous carbon material layer 2022 has high secondary electron collection efficiency and detection accuracy.

Figure 4:
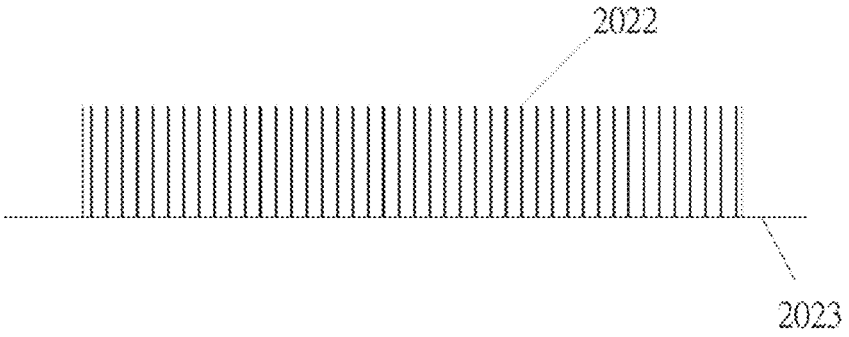
FIG. 4 is a structure schematic diagram of one embodiment of a porous carbon material layer located on a surface of an insulating substrate.

Referring to FIG. 4, in one embodiment, the porous carbon material layer 2022 is located on a surface of an insulating substrate 2023. The insulating substrate 2023 can be a flat structure. The insulating substrate 2023 can be a flexible substrate or a rigid substrate. For example, a material of the insulating substrate 2023 can be glass, plastic, silicon wafer, silicon dioxide wafer, quartz wafer, polymethyl methacrylate (PMMA), polyethylene terephthalate (PET), silicon, silicon with oxide layer, or quartz. A size of the insulating substrate 2023 is selected according to actual needs. In one embodiment, the insulating substrate 2023 is a silicon substrate, and the porous carbon material layer 2022 is located on a surface of the silicon substrate.

The secondary electron probe 2021 is not limited to the porous carbon material layer 2022. In one embodiment, the secondary electron probe 2021 uses other materials.

Figure 5:
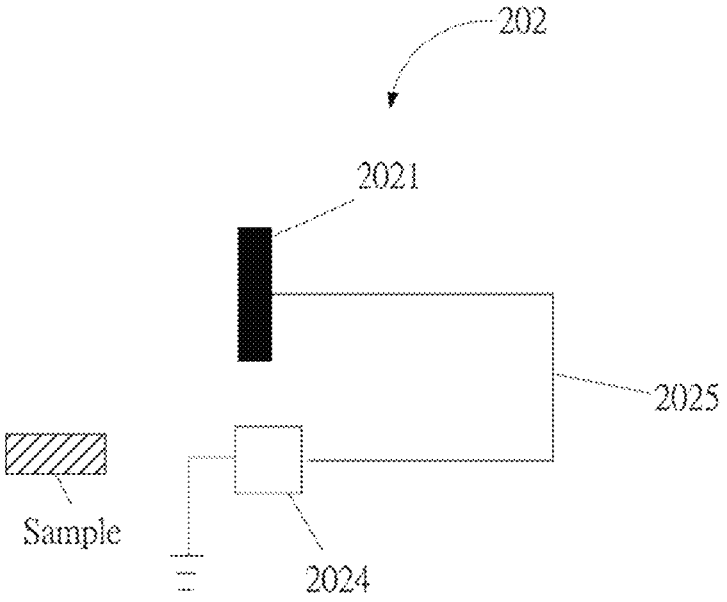
FIG. 5 is a structure schematic diagram of one embodiment of a secondary electron detection element.

Referring to FIG. 5, in one embodiment, the secondary electron detection element 202 further comprises a test unit 2024. The test unit 2024 is electrically connected to the secondary electron probe 2021 by a wire 2025. The test unit 2024 is used to test the secondary electrons collected by the secondary electron probe 2021 and perform a numerical conversion. The test unit 2024 can be but not limited to an ammeter, a voltmeter or a temperature display. In one embodiment, the test unit 2024 is the ammeter, when the secondary electrons collected by the secondary electron probe 2021 are transmitted to the ammeter through the wire, a current value data generated by the secondary electron can be read by the ammeter, and thus an amount of the secondary electrons emitted from the surface of the sample can be obtained.

When the secondary electron detection device 20 is in use, the secondary electron detection element 202 can be connected to an output unit. The output unit can be but not limited to an image display or an alarm. In one embodiment, the output unit is an LCD display, and the current signal measured by the test unit 2024 forms an image in the LCD display and output.

Figure 6:
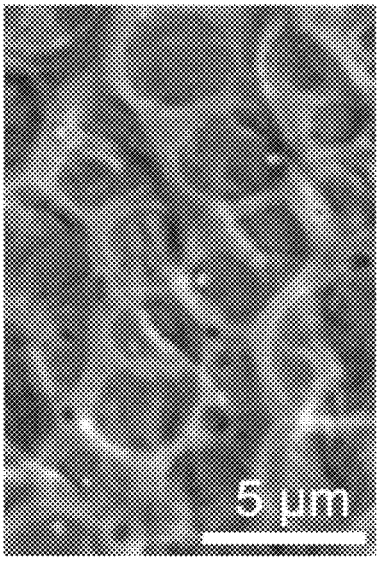
(Related Art) FIG. 6
FIG. 6 is a surface image of a sample tested by a conventional secondary electron detection device with a metal cavity.
Figure 7:
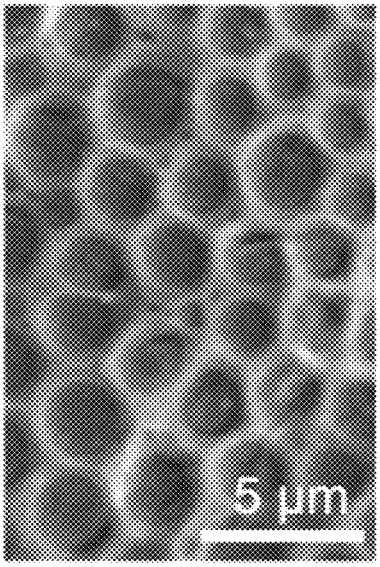
FIG. 7 is a surface image of the sample shown in FIG. 6, but tested by a secondary electron detection device with the electronic blackbody cavity in FIG. 1.

FIG. 6 is a surface image of a sample tested by a conventional secondary electron detection device with a metal cavity. FIG. 7 is a surface image of a sample tested by the secondary electron detection device 20 of the present invention. The secondary electron detection devices of FIG. 6 and FIG. 7 are the same except the cavity, and the test samples are also the same. It can be seen that the surface image of the sample in FIG. 7 is much clearer than that in FIG. 6. It shows that the secondary electron detection device 20 of the present invention shields the secondary electrons generated in the cavity well, and a detection accuracy of secondary electrons on the surface of the sample is higher.

Figure 8:
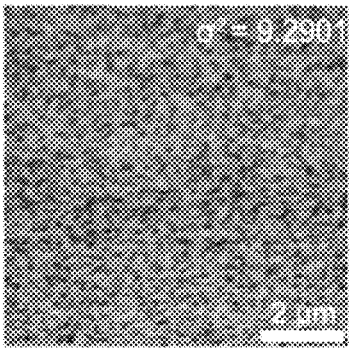
(Related Art) FIG. 8
FIG. 8 is an image of a sample detected by the conventional secondary electron detection device with the metal cavity in FIG. 6.
Figure 9:
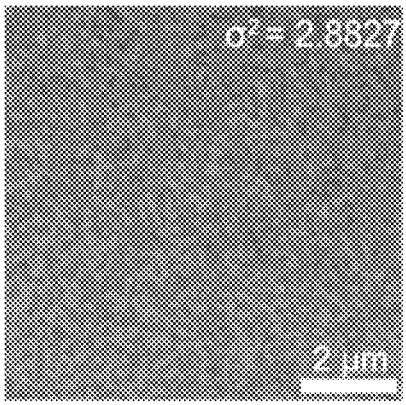
FIG. 9 is an image of the sample shown in FIG. 8, but detected by the secondary electron detection device with the electronic blackbody cavity in FIG. 1 shown in FIG. 7.

FIG. 8 is an image of a sample detected by the conventional secondary electron detection device. FIG. 9 is an image of a sample detected by the secondary electron detection device of the present invention. The sample in FIG. 8 and the sample in FIG. 9 are both a flat silicon wafer deposited with a thickness of 100 nm Au layer. It can be seen that the image in FIG. 9 is much clearer than the image in FIG. 8. Further, an image variance of the image in FIG. 8 is 9.29, and an image variance of the image in FIG. 9 is just 2.88. It shows that when detecting the same sample, the image variance of the sample image obtained by the secondary electron detection device of the present invention is much smaller than that obtained by the conventional secondary electron detection device. Therefore, an image quality of the image of the sample obtained by the secondary electron detection device of the present invention is much higher than that of the image of the sample obtained by the conventional secondary electron detection device.

Figure 10:
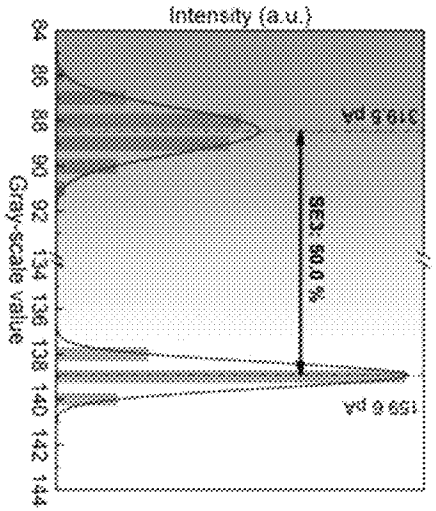
FIG. 10 is a grayscale image of a sample detected by the conventional secondary electron detection device with the metal cavity shown in FIG. 6, and by the secondary electron detection device with the electronic blackbody cavity in FIG lshown in FIG. 7.

FIG. 10 is a grayscale image of a same sample detected by the conventional secondary electron detection device and the secondary electron detection device of the present invention. The same sample is a flat silicon wafer deposited with a thickness of 100 nm Au layer. It can be seen that, compared with the conventional secondary electron detection device, the gray value of the sample obtained by the secondary electron detection device of the present invention is relatively uniform and the fluctuations are smaller.

The secondary electron detection device provided by the present invention has the following advantages: first, the inner surface of the electronic blackbody cavity is provided with a porous carbon material layer, and the porous carbon material layer can be regarded as an absolute blackbody of electrons. Therefore, when an electron beam hits the inner surface of the electron blackbody cavity, electrons are completely absorbed by the porous carbon material layer located on the inner surface, and the secondary electrons escaping from the surface of the electron blackbody cavity are also absorbed by the porous carbon material layer and not emitted out. Therefore, the electronic blackbody cavity has an excellent electronic shielding effect; and the secondary electrons detected by the secondary electron detection device using the electronic blackbody cavity are substantially emitted from the surface of the sample, and the detection accuracy is very high. Second, the secondary electron probe of the secondary electron detection device can comprise a porous carbon material layer, and the porous carbon material layer can be regarded as an absolute blackbody of secondary electrons. Therefore, the porous carbon material layer has an excellent collection effect on secondary electrons, and when the secondary electron detection element is used to detect the secondary electrons escaping from the sample surface, there is substantially no secondary electrons is missed; thereby improving the detection accuracy of the secondary electron detection device. Further, the material of the plurality of carbon material particles only consists of carbon atoms, the carbon atoms has excellent electrical conductivity, thereby improving the electronic shielding effect. Finally, the porous carbon material layer can be a carbon nanotube structure, the carbon nanotube structure has excellent electrical conductivity, flexibility and strength, and thus the carbon nanotube structure can be used in extreme environments such as high temperature and low temperature; and the secondary electron detection device has a wide range of applications. Since a weight of the carbon nanotube structure is light, which is conducive to actual operation, the secondary electron detection device can be suitable for micro-devices with strict requirements on quality and volume.

It is to be understood that the above-described embodiments are intended to illustrate rather than limit the present disclosure. Variations may be made to the embodiments without departing from the spirit of the present disclosure as claimed. Elements associated with any of the above embodiments are envisioned to be associated with any other embodiments. The above-described embodiments illustrate the scope of the present disclosure but do not restrict the scope of the present disclosure. Depending on the embodiment, certain of the steps of a method described may be removed, others may be added, and the sequence of steps may be altered. The description and the claims drawn to a method may include some indication in reference to certain steps. However, the indication used is only to be viewed for identification purposes and not as a suggestion as to an order for the steps.

What is claimed is:

1. An electronic blackbody cavity comprising:

an inner surface;

a chamber surrounded by the inner surface;

an opening configured to allow an electron beam enter the chamber; and a porous carbon material layer on the inner surface, wherein the porous carbon material layer comprises a plurality of carbon material particles, and a material of the plurality of carbon material particles consists of carbon atoms, and the plurality of carbon material particles defines a plurality of micro gaps.

2. The electronic blackbody cavity of claim 1, wherein the plurality of carbon material particles comprise at least one of linear particles and spherical particles.

3. The electronic blackbody cavity of claim 2, wherein a diameter of a cross section of each of the linear particles is less than or equal to 1000 micrometers, and a diameter of each of the spherical particles is less than or equal to 1000 micrometers.

4. The electronic blackbody cavity of claim 2, wherein the linear particles are carbon fibers, carbon micron-wires, or carbon nanotubes.

5. The electronic blackbody cavity of claim 2, wherein the spherical particles are carbon nanospheres or carbon microspheres.

6. The electronic blackbody cavity of claim 1, wherein the porous carbon material layer is a carbon nanotube array or a carbon nanotube network structure.

7. The electronic blackbody cavity of claim 6, wherein the carbon nanotube network structure is a carbon nanotube sponge, a carbon nanotube film structure, a carbon nanotube paper, or a network structure.

8. The electronic blackbody cavity of claim 1, wherein a thickness of the porous carbon material layer is in a range from 200 micrometers to 600 micrometers.

9. The electronic blackbody cavity of claim 1, wherein the porous carbon material layer is a super-aligned carbon nanotube array, and a height of the super-aligned carbon nanotube array is in a range from 350 micrometers to 600 micrometers.

10. The electronic blackbody cavity of claim 1, wherein a size of each micro gap of the plurality of micro gaps is less than or equal to 100 micrometers.

11. A secondary electron detection device comprising:

an electronic blackbody cavity comprising:

an inner surface;

a chamber surrounded by the inner surface;

an opening configured to allow an electron beam enter the chamber; and a first porous carbon material layer on the inner surface, wherein the first porous carbon material layer comprises a plurality of first carbon material particles, and a material of the plurality of first carbon material particles consists of carbon atoms, and the plurality of first carbon material particles defines a plurality of micro gaps; and a secondary electron detection element located in the chamber.

12. The secondary electron detection device of claim 11, wherein the plurality of first carbon material particles is selected from carbon fibers, carbon micron-wires, carbon nanotubes, carbon nanospheres and carbon microspheres.

13. The secondary electron detection device of claim 11, wherein the first porous carbon material layer is a carbon nanotube array or a carbon nanotube network structure.

14. The secondary electron detection device of claim 13, wherein the carbon nanotube network structure is a carbon nanotube sponge, a carbon nanotube film structure, a carbon nanotube paper, or a network structure.

15. The secondary electron detection device of claim 11, wherein the secondary electron detection element comprises a secondary electron probe, the secondary electron probe comprises a second porous carbon material layer, and the second porous carbon material layer is insulated from the first porous carbon material layer.

16. The secondary electron detection device of claim 15, wherein the second porous carbon material layer consists of a plurality of second carbon material particles and a plurality of second micro gaps, the plurality of second micro gaps are defined by the plurality of second carbon material particles.

17. The secondary electron detection device of claim 16, wherein the plurality of second carbon material particles is selected from a group consisting of carbon fibers, carbon micron-wires, carbon nanotubes, carbon nanospheres and carbon microspheres.

18. The secondary electron detection device of claim 15, wherein the second porous carbon material layer is a carbon nanotube array or a carbon nanotube network structure.

19. The secondary electron detection device of claim 18, wherein the carbon nanotube network structure is a carbon nanotube sponge, a carbon nanotube film structure, a carbon nanotube paper, or a network structure.

20. The secondary electron detection device of claim 15, wherein a material of the plurality of second carbon material particles consists of carbon atoms.

* * * * *